US005165744A

United States Patent [19]

Vogrin

[11] Patent Number: 5,165,744

[45] Date of Patent: Nov. 24, 1992

[54] DEVICE FOR POSITIONING AND RETRIEVING GOLF BALLS AND GOLF TEES

[76] Inventor: Lotte K. Vogrin, 158 Underhill Dr., Don Mills, Ontario, Canada, M3A 2K5

[21] Appl. No.: 766,228

[22] Filed: Sep. 27, 1991

[51] Int. Cl.[5] ..... A63B 47/02

[52] U.S. Cl. ..... 294/19.2; 273/32.5; 294/24

[58] Field of Search ..... 294/19.1, 19.2, 24, 294/61; 273/32 B, 32 F, 32.5, 33, 162 R, 162 E, 162 F

[56] References Cited

U.S. PATENT DOCUMENTS

| | | | |
|---|---|---|---|
| 2,609,198 | 9/1952 | Armstrong | 294/19.2 X |
| 2,750,222 | 6/1956 | Borah | 294/19.2 |
| 3,904,200 | 9/1975 | Jackle et al. | 273/32.5 |
| 4,313,604 | 2/1982 | Baxter | 294/19.2 X |
| 4,466,650 | 8/1984 | Roedel | 294/19.2 |
| 4,526,36[illegible] | 7/1985 | Phelps | 294/19.2 X |
| 4,616,826 | 10/1986 | Trefts | 294/19.2 X |
| 4,949,961 | 8/1990 | Milano | 294/19.2 X |
| 4,951,947 | 8/1990 | Kopfle | 294/19.2 X |
| 5,037,150 | 8/1991 | Vecchi | 294/19.2 |

*Primary Examiner*—Johnny D. Cherry
*Attorney, Agent, or Firm*—Jane Parsons

[57] ABSTRACT

A device for golfers to pick up golf balls and golf tees and to locate balls and tees is intended to reduce the need of a golfer to bend bown to the ground. The device includes an elongated tube having a golf ball holding cup at one end and a shallow tee holding socket and a tee retrieving device at the other end. A ball may be set in the cup to be secured against falling under its own weight and may be dislodged therefrom by movement of a coaxial rod to project into the cup. A tee lodged in the socket may be similarly dislodged by movement of the rod in the other direction. Lugs are provided in slots of the tube so that the user may move the rod appropriately. A two tined fork projects at one end of the device as a hook to retrieve a tee.

15 Claims, 5 Drawing Sheets

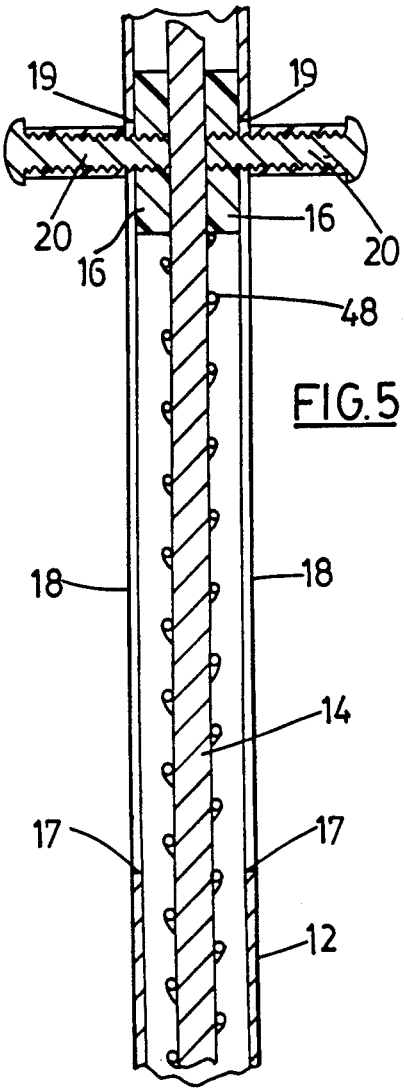
FIG.5
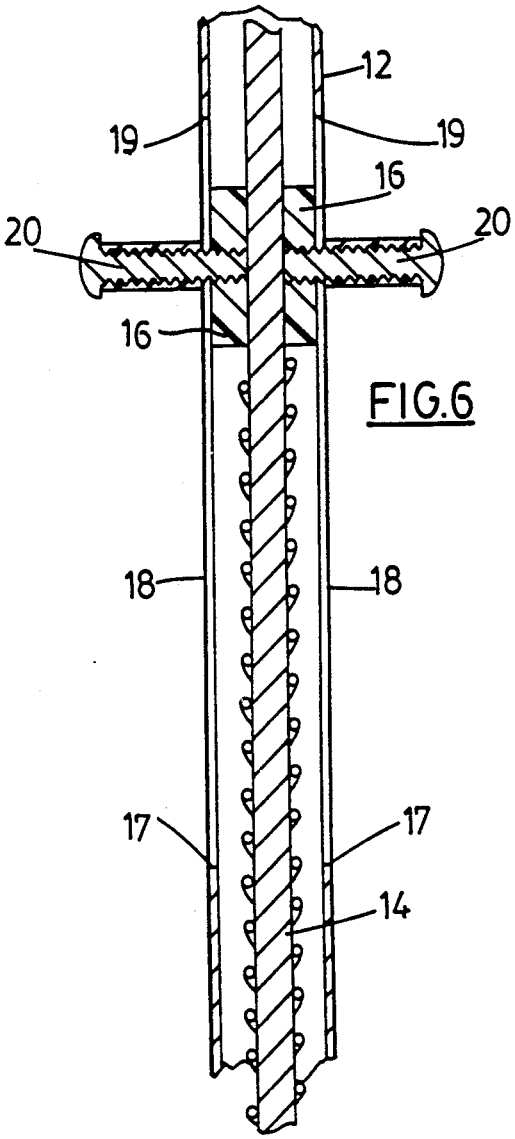
FIG.6
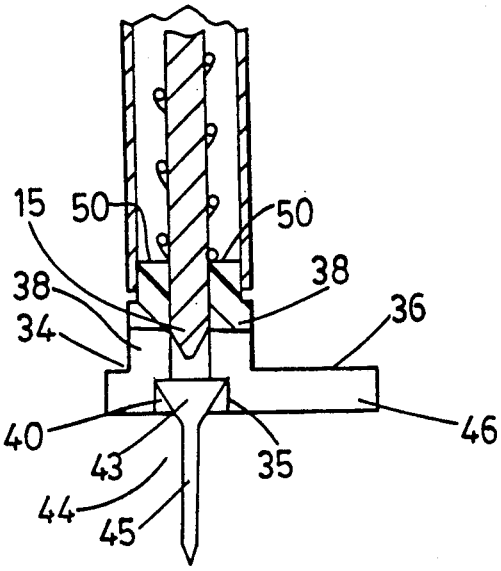
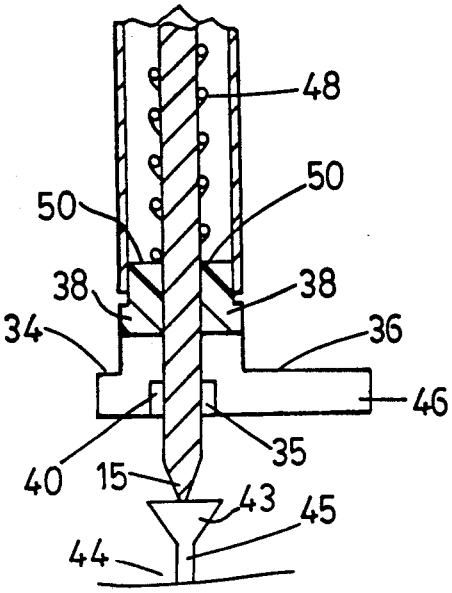

DEVICE FOR POSITIONING AND RETRIEVING GOLF BALLS AND GOLF TEES

FIELD OF THE INVENTION

This invention relates to a device for retrieving and positioning golf balls and golf tees.

DISCUSSION OF THE PRIOR ART

Over the years a larger of number of golf aids have been devised intended to alleviate the need for a golfer to bend over to retrieve articles from the ground.

Among examples of such devices may be those disclosed in:

U.S. Pat. No. 4,969,646, issued to Tobias on Nov. 13, 1990;

U.S. Pat. No. 4,951,947, issued to Kopfle on Aug. 28, 1990;

U.S. Pat. No. 4,819,938, issued to Hill on Apr. 11, 1989;

U.S. Pat. No. 4,616,826, issued to Trefts on Oct. 14, 1986;

U.S. Pat. No. 4,589,661, issued to Attig on May 20, 1986;

U.S. Pat. No. 4,526,369, issued to Phelps on Jul. 2, 1985;

U.S. Pat. No. 4,462,595, issued to Hodson on Jul. 31, 1984;

U.S. Pat. No. 3,904,200, issued to Jackle et al on Sep. 9, 1975;

U.S. Pat. No. 3,206,197, issued to Miotke on Sep. 14, 1965;

U.S. Pat. No. 2,943,856, issued to Eimerman on Jul. 5, 1960; and

U.S. Pat. No. 2,609,198, issued to Armstrong on Sep. 2, 1952.

All of the above referred to patents are exemplary of attempts to solve one or more of the problems associated with the positioning or retrieval of objects from the ground, especially in golf.

In spite of the plethora of prior art in the field, it is believed that no device has been available which satisfactorily fulfills the desiderata of easy portability, light weight, handling ease, efficient placement of both tees and golf balls, and retrieval of both tees and golf balls. The present inventor addresses these problems.

SUMMARY OF THE INVENTION

According to the invention there is provided a device for retrieving and positioning golf balls and golf tees comprising an open-ended elongate hollow tube having a first tube end and a second tube end; an elongate rod corresponding in length to the tube and located slidably coaxially within the tube, the rod having a first rod end and a second rod end; a cup axially aligned with the tube and attached thereto at the first tube end, the cup being shaped, at least at a cup distal end, to grip a golf ball against falling under its own weight, and the cup, at a proximal end, opening into the tube to allow passage for said rod; a presser foot for locating and pressing a golf tee into the ground, the foot being attached to the second tube end and comprising an abutment and a resilient fastener to grip a golf tee head circumferentially, and to act on a golf tee located in the fastener whereby downward axial pressure exerted on the abutment is transmitted to the tee, the resiliency and dimension of the fastener being selected so that the fastener is disengageable from the golf tee head; a hook at the second tube end to engage a golf tee head to lift the golf tee; actuating means to slide the rod in the tube in one direction to project the first rod end into the cup whereby a ball lodged in the cup is ejected therefrom, and in the other direction to withdraw the rod from the cup.

The resilient fastener may be located coaxially with the tube and the second rod end may comprise the abutment, whereby sliding of the rod in said other direction exerts pressure on a golf tee head circumferentially gripped by the resilient fastener to disengage it therefrom. The abutment may alternatively or additionally comprise a stop surface attached to the tube and located to bear on a golf tee head gripped circumferentially by said fastener when downward pressure is exerted on the tube, and the resiliency and dimension of the fastener being selected so that the fastener is disengageable from a golf tee head under tension between the tube and the tee. The stop surface may be an annulus coaxial with the tube at its second tube end and forming the base of a socket in which the tee head is gripped.

The ball gripping socket may be formed of resilient material such as rubber and may have an internal configuration having at least means to grip the ball. In one embodiment, the inner shape of the socket may be a section of a sphere, e.g. a hemisphere. Preferably, the gripping edge of the hemisphere is provided with at least one shallow rib projecting inwardly. Such rib or ribs may have an advantageous effect on both holding of the ball and on easy release of the ball from the cup.

The second rod end may be pointed to form a spike and the second rod end is projectable from the second tube end in a support length embeddable in the ground to support the device in a generally upright position. At least in this case, it may be desirable that biasing means are provided to bias the rod into a position in which at least the second rod end is housed with the tube. Thus, the spike is easily withdrawable into the shaft when not in use to support the device.

The actuating means may comprise at least one axially extending slot in the tube and a cooperating lug attached to the rod and projecting through the slot. For example, one or two pairs of diametric slots and cooperating lugs may be provided. Each pair of slots may be located along the length of the shaft so that the lugs projecting from one pair are easily accessible, whichever way up the device is held.

A generally cylindrical hand-grip may be provided for the tube between its ends. The position of the hand-grip may be slidably adjustable along the length of the tube when free from manual gripping force thereon, and the hand-grip is tight on the tube under manual gripping force.

BRIEF DESCRIPTION OF THE DRAWINGS

FIG. 5 is a longitudinal section of a tee holding and positioning device at a second end of a device of FIG. 1 with a tee located therein;

FIG. 6 is a similar section of the tee holding and positioning device of FIG. 5 with the tee ejected therefrom;

DETAILED DESCRIPTION OF A PREFERRED EMBODIMENT

Figure 1:
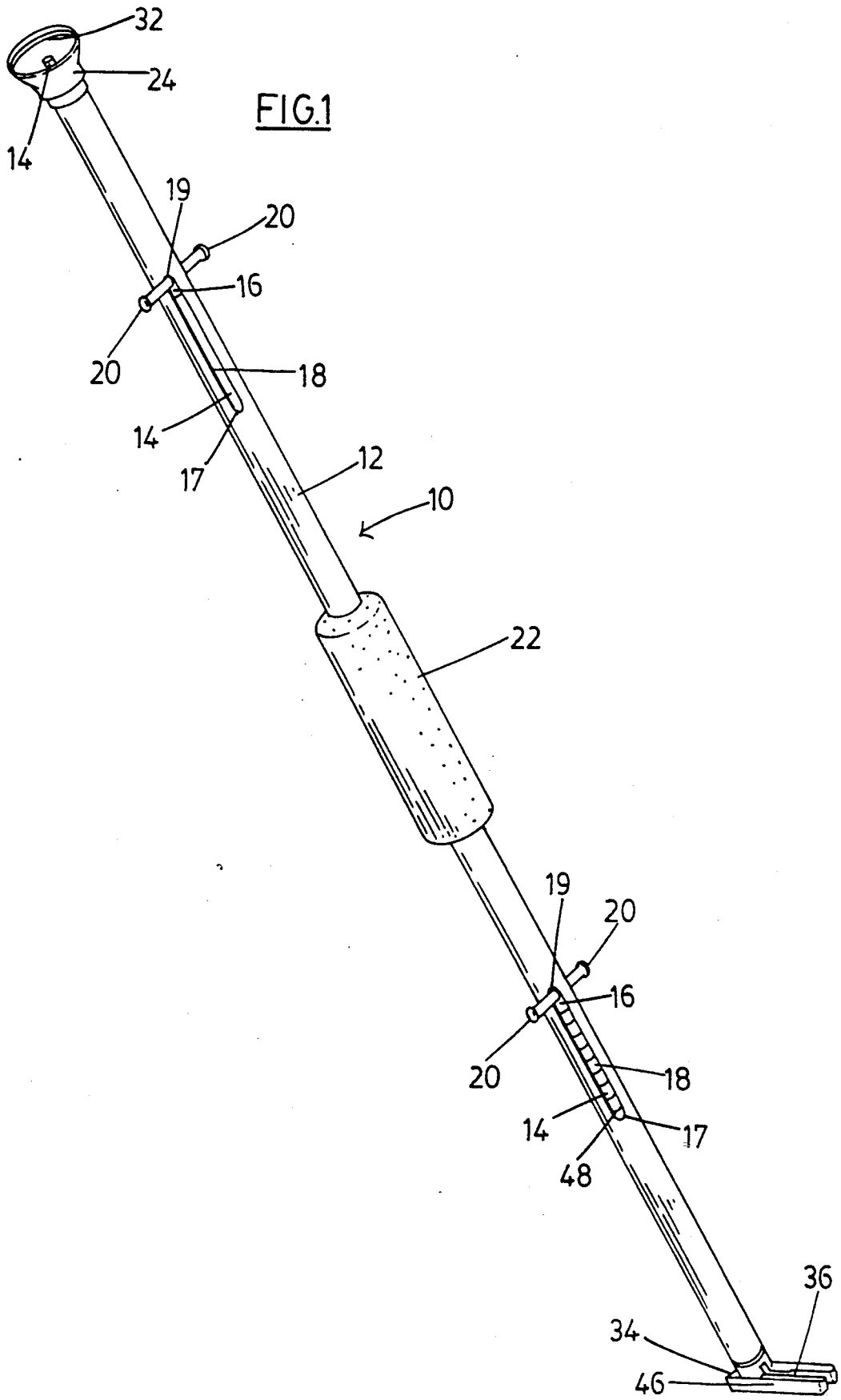
FIG. 1 is a perspective view of one exemplary device of the invention.
Figure 2:
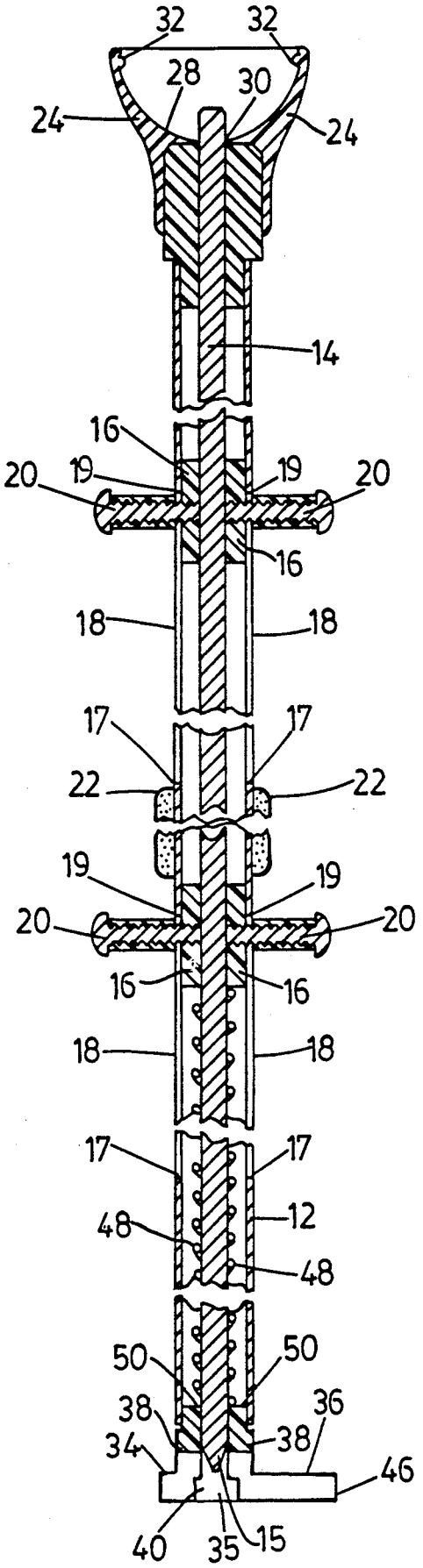
FIG. 2 is a longitudinal section of the device of FIG. 1.
Figure 3:
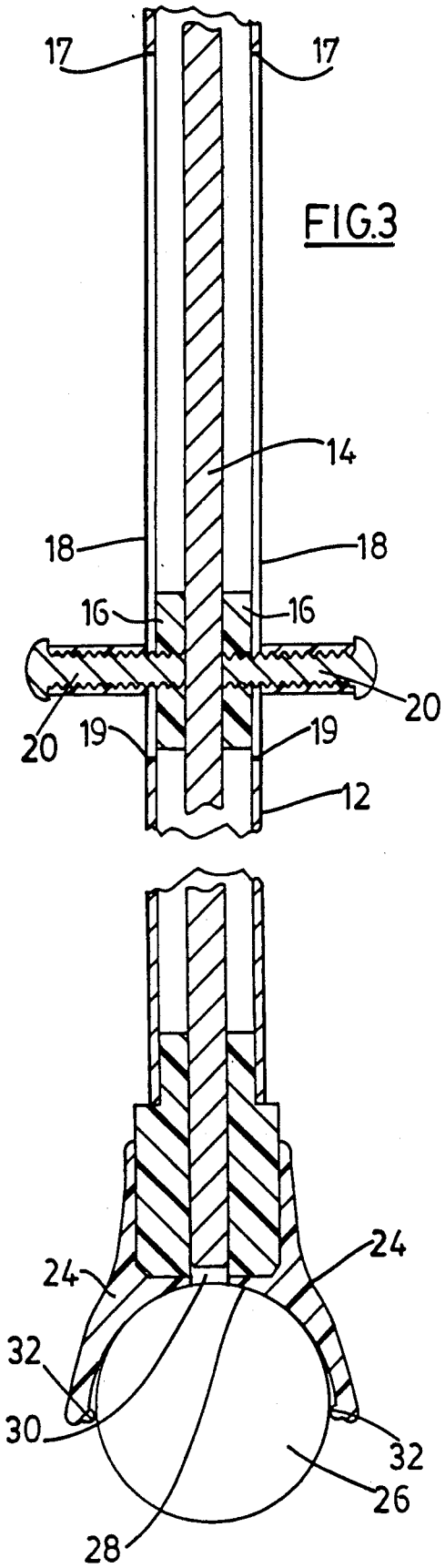
FIG. 3 is a longitudinal section of a golf ball holding cup of a device of FIG. 1 with a golf ball located therein.

In the drawings, FIG. 1 generally illustrates a device 10 for retrieving and positioning golf balls and tees. The device 10 comprises a hollow, open ended cylindrical tube 12 and a coaxial rod 14 of similar length to the tube 12 and slidably housed within tube 12.

To maintain the coaxial position of rod 14 and to provide for easy sliding of rod 14 within tube 12, rod 14 is fixed in slide-blocks 16 which have a similar diameter to the internal diameter of tube 12 and slide within it.

Slide-blocks 16 may suitably be formed from nylon or DELRIN (trade mark) or other material with low friction characteristics to allow for easy sliding.

Actuating means to actuate sliding of rod 14 in tube 12 may comprise two pairs of diametrically opposed longitudinal slots 18 in the tube 12, through each slot of which a cooperating lug 20 of the rod 14 projects. Thus, a user may slide rod 14 within tube 12 by moving the lugs 20 in slots 18.

One pair of slots 18 is located somewhat towards one end of tube 12 and the other pair of slots 18 is located somewhat towards the other end. The actual location of each pair of slots 18 and lugs 20 on the tube is selected so that, when the tube is vertical with either end close to ground level, one of the pairs of slots 18 and lugs 20 will be conveniently to hand for a user without the necessity of undue bending.

All the slots 18 will be of similar length. The length of slots 18 limits the travel of rod 14 within tube 12. Thus, the length of the slots 18 and the location of lugs 20 with respect to slot ends 17, 19 are chosen for proper operation of the golf ball and golf tee handling operations described below.

Each pair of lugs 20 is fixed with rod 14 through one of the slide blocks 16 in which one end of each lug 20 is embedded, for example, screw threadedly embedded, to project diametrically through slots 18.

This arrangement of moving the rod 14 fixed with the slide-blocks 16 by means of lugs 20 is envisaged to provide an arrangement in which the rod 14 fixed with slide-blocks 16 slides coaxially within the tube.

Between the pairs of slots 18 and lugs 20 a handgrip 22 is provided. Handgrip 22 may be a generally cylindrical sleeve and it may be formed from a material and have an internal diameter such that it slides easily on the tube 12 when the user is not manually gripping it, but, when it is gripped in the hand of a user, it tightens on the tube and does not easily slip on it. Suitable material from which the hand grip 22 may be formed is, for example, foam rubber.

A golf ball positioning and retrieval cup 24 is located at one end of tube 12. It may comprise a substantially hemispherical cup having an internal dimension to grip a golf ball 26 so that it may be supported in the downwardly open cup without falling out under its own weight. Suitably, the cup 24 may be made of slightly resilient material so that it has some flexibility to release the golf ball 26 when required to do so. While the shape of the cup is conveniently hemispherical, some departure from this shape is possible. For example, the shape may, while conforming to the shape of a chordal section of the golf ball, need not be a full hemisphere. A minor section sufficient to grip the ball is sufficient. Moreover, it is not necessary that the internal shape be a hemisphere at all, providing that a ball gripping band is present.

The cup 24 suitably grips the golf ball 26 through friction, through the bias exerted through the provision of a suitably dimensioned resilient cup, or even through a suction cup effect. As illustrated, the internal dimensions of cup 24 conform to the shape of a golf ball 26 so as to provide a tight fit. An inwardly projecting circumferential rib 32 may provide enhanced grip of the ball while allowing easy removal of the ball of the cup. The effect of rib 32 is believed to hold at least a small part of the inner surface of the cup out of contact with the ball so that excessive holding effect of suction may not occur. Resiliency of the material from which the cup is formed may enhance the grip. Suitable materials from which the cup 24 may be formed may include, for example, rubber.

The cup 24 is connected to tube 12 through its base 28 to be coaxial therewith. Base 28 is provided with a coaxial aperture 30 to allow passage of one end of rod 14 on sliding in one direction. The cup 26 may be connected to tube 12 in any convenient manner as, for example, by screw threaded engagement or by friction fit male and female joints between them. Alternatively or additionally, fastening studs may be provided between them.

Figure 4:
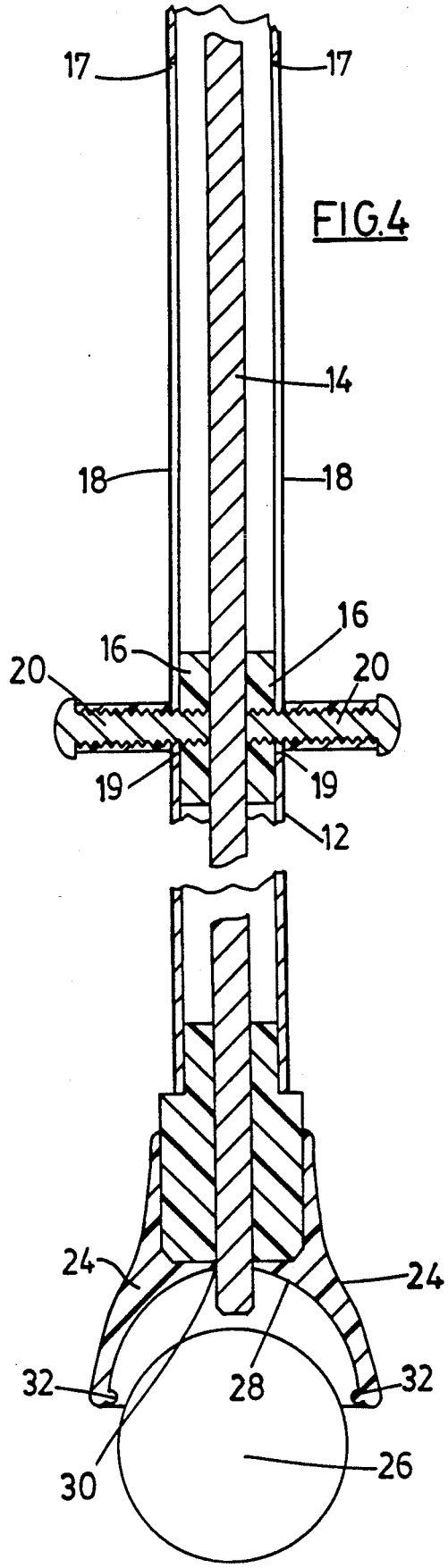
FIG. 4 is a similar section of the cup of FIG. 3 with the golf ball ejected therefrom.
Figure 7:
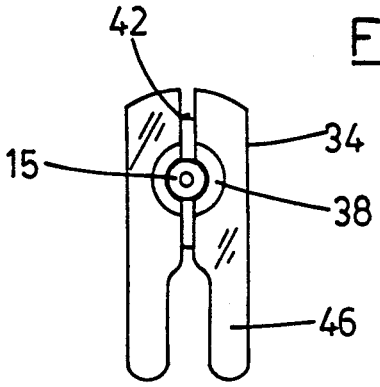
FIG. 7 is a view of the second end of the device of FIG. 1 showing a tee retrieval hook.
Figure 8:
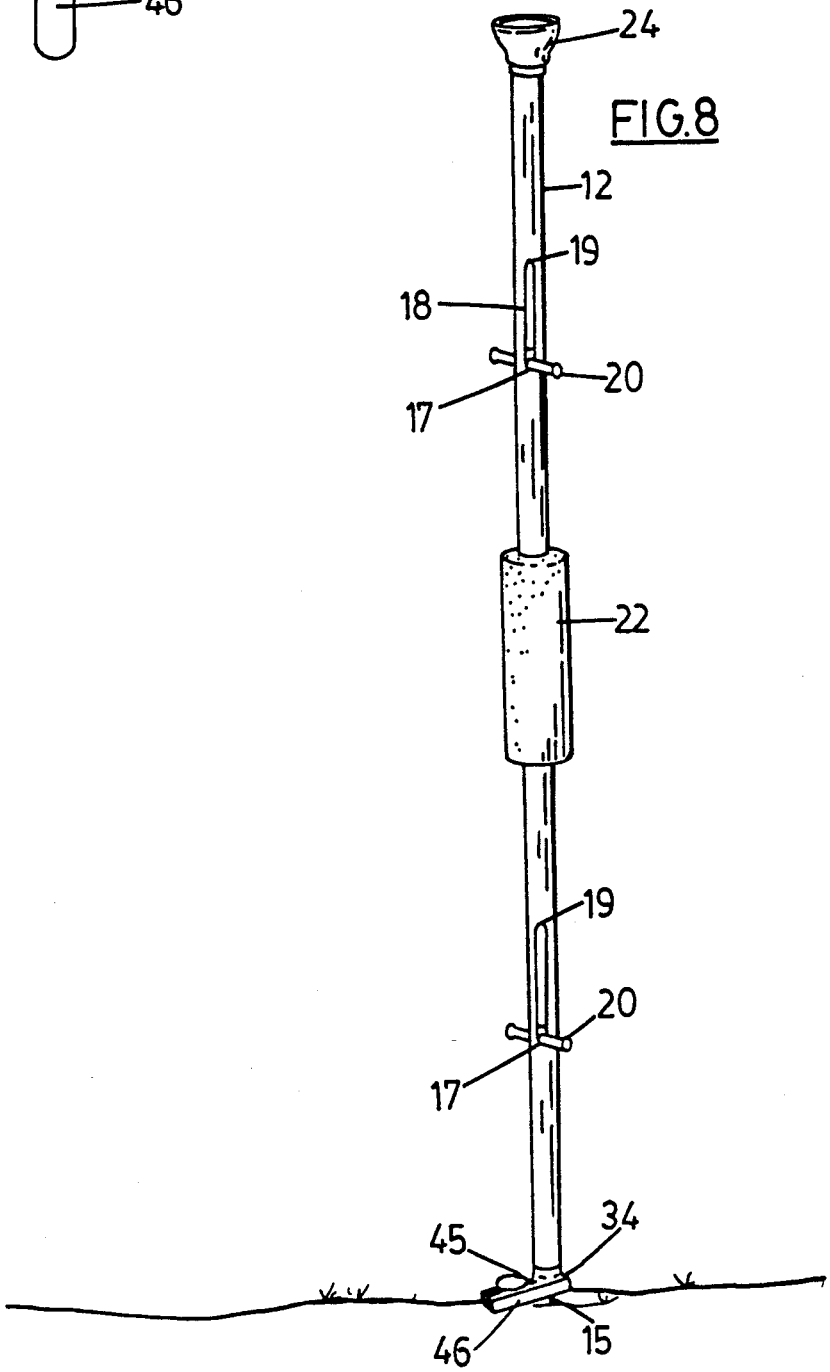
FIG. 8 is a sketch showing the device supported with its support spike embedded in the ground.

In operation, to retrieve a golf ball from the ground without the necessity of the golfer bending down to pick it up, the device may be utilized as follows:

The tube 12 is held by the user in a generally vertical position with the cup 24 open downwardly. If the rod 14 should projects into cup 24 at this time, it will be retracted by pressure of the ball as it is put into the cup. The device should be located so that cup 24 opens directly above golf ball 26 to be retrieved. The cup 24 is lowered onto the golf ball and, perhaps, a small amount of pressure may be exerted to locate golf ball 26 in cup 24. The device may then be reversed or lifted so that the cup 24 is conveniently accessible by the user and the ball may be picked out of it. Removal of the ball may be easier if lugs 20 are moved in slots 18 to slide rod 14 to project at one end of it into cup 24 to dislodge ball 26 (see FIG. 4). In fact, movement of rod 14 in tube 12 should be slight, since minimal movement is required to dislodge the ball gently and considerable accuracy is required when placing the ball on a tee. Slot end 19 provides a stop for movement of the rod in this direction.

To position a ball on the ground or on a tee, the device is located with the cup 24 easily accessible to the user, the ball 26 is placed in the cup, the cup is positioned to open downwardly over the desired location of the ball, and rod 14 is projected into cup 24 by movement of lugs 20 in slots 18 to dislodge the ball. It may be advantageous that rod 14 does not project very far into cup 24 so that ejection of the ball is not too vigorous.

A tee positioning device 34 and a tee retrieval device 36 are located at the other end of tube 12. The tee positioning device 34 formed of resilient material such as nylon or DELRIN (trade mark) comprises a shallow socket 35 having a shallow vertical wall 40 and an annular base 38 generally sized so that its outside circumference conforms with the head 43 of the tee 44. A diametric split 42 through both the base 38 and the wall 40 allows for expansion of the base to exert bias against such expansion.

The tee retrieval device 36 comprises a two pronged fork 46 extending from the tee positioning device 34 to extend and widen the split 42 and to accommodate the thickness of a prong 45 of the tee 44 between the tines of the fork. The combined tee positioning device 34 and tee retrieval device 36 may be fixed to the end of tube 12 in any suitable manner including any of those exemplified for the connection of ball holding cup 24 to the other end of tube 12.

In operation, to set a tee in the ground, the user may locate socket 35 so that it is easily accessible to him. He may then expand the circumference of the socket and set a tee head thereinto so that the circumference of the tee head 43 is gripped by the shallow wall 40. Expansion of the socket 35 may be by snapping the tee into place or by using tines of fork 46 as levers to open slit 42. If the tines of fork 46 are used as levers, the wall 40 will grip tee head 43 as soon as the user stops using pressure to maintain them open. Once the tee 44 is held with its head 43 gripped in socket 35 and its prong 45 projecting outwardly, the tube 12 may be reversed and located with the tee prong 45 ready for insertion into the ground at the desired location. Downward pressure on the tube 12 will cause an abutment comprised by either end 15 of rod 14 or socket base 38 or both, to bear downwardly on the tee 44 to press the prong 45 into the ground. It may be possible, at this point, to remove the device 10 from the embedded tee 44 by lifting the device to exert tension between the tee 44 and the tee position device 34 and snap the tee out of engagement therewith when the resilience and dimensions of the device 34 are suitable selected. It is possible, however, that this action will tend to lift the tee out of the ground. It is, therefore, preferable to move lugs 20 in slots 18 to slide the rod 14 downwardly so that the respective end 15 passes through annular socket base 38 to push against tee head 43 to disengage it.

When it is desired to retrieve a tee which is either loose on the ground or embedded in the ground, it may be hooked upwardly by fork 46. The fork must be such as to accommodate tee prong 45 between its tines while not allowing passage of tee head 43 therebetween and lug 46 to each side of the prong 45. The tee may then be lifted on the hook formed by lugs 46.

Rod end 15 may suitably be spiked, and, through suitable positioning of slot ends 17, be projectable for a support length sufficient to allow the user to insert the support length in the ground to support the device 10 upright in an unattended position.

When rod end 15 is formed as a spike, it is undesirable that the spike project at all times when a tee is not lodged in the saucer at least for safety and convenience reasons. Biasing means may be provided to bias the rod 14 into a position in which its spiked end 15 does not project from the tube. The biasing means may be a helical spring 48 about rod 14 between a slide block 16 and a surface 50 of socket base 38 directed inwardly of tube 12. This spring 48 tends to bias the block 16 to retract the rod 14 into the tube.

I claim:

1. A device for retrieving and positioning golf balls and golf tees comprising:

an open ended elongate hollow tube having a first tube end and a second tube end;

an elongate rod corresponding in length to the tube and located slidably co-axially within the tube, the rod having a first rod end and a second rod end;

a preformed downwardly open socket axially aligned with the tube and attached thereto at the first tube end, the socket being shaped and sized, at least at a socket distal end, to conform with the shape and size of a golf ball whereby to grip a golf ball against falling under its own weight, and the socket, at a proximal end, opening into the tube to allow passage for said rod;

a presser foot for locating and pressing a golf tee into the ground, the foot being attached to the second tube end and comprising a resilient fastener to encircle and releasably grip a golf tee head circumferentially;

an abutment to act on a golf tee to transmit downward axial pressure from the abutment to the tee;

a fork at the second tube end extending from the presser foot as two prongs spaced apart to span a shank of the golf tee and to engage a golf tee head to lift the golf tee; and actuating means to slide the rod in the tube in one direction to project the first rod end into the socket whereby a ball lodged in the socket is ejected therefrom, and in the other direction to withdraw the rod from the socket.

2. A device as claimed in claim 1, in which the resilient fastener is located coaxially with the tube and the abutment is provided at the second rod end whereby sliding of the rod in said other direction contracts the abutment on a golf tee head circumferentially gripped by the resilient fastener to release it therefrom.

3. A device as claimed in claim 1, in which the abutment comprises a stop surface of the presser foot to bear on a golf tee head gripped circumferentially by said fastener when downward pressure is exerted on the tube, the fastener being releasable from the tee head under tension between the tube and the tee.

4. A device as claimed in claim 3, in which the stop surface is an annulus coaxial with the tube at its second tube end.

5. A device as claimed in claim 4, in which the abutment also is partially provided at the second rod end which is projectable from the second tube end to exert bias on the tee to disengage it from the fastener.

6. A device as claimed in claim 1, in which the second rod end is pointed and the second rod end is projectable from the second tube to be embedded in the ground.

7. A device as claimed in claim 6, in which biasing means are provided to bias the rod into a position in which at least the second rod end is housed within the tube.

8. A device as claimed in claim 1, in which the actuating means comprise at least one axially extending slot in the tube and a cooperating lug attached to the rod and projecting trough the slot.

9. A device as claimed in claim 8, in which a pair of diametric slots and cooperating lugs are provided.

10. A device as claimed in claim 9, in which two pairs of diametric slots and cooperating lugs are provided, each pair being located axially separated locations along the tube.

11. A device as claimed in claim 1, in which a generally cylindrical hand grip for the tube is provided at a mid-portion of the tube between its end, the hand grip being slidably adjustable along the length of the mid-portion when free from manual gripping force thereon, and the hand grip being tight on the tube under manual gripping force.

12. A device as claimed in claim 1, in which the socket has an inner surface conformed to the shape of a spherical segment of a golf ball.

13. A device as claimed in claim 12, in which at least one inwardly directed circumferential rib is provided about an inner edge portion of the socket.

14. A device as claimed in claim 13 in which the inner surface of the socket is substantially hemispherical.

15. A device as claimed in claim 12, in which the socket is resiliently biased to grip a golf ball located in it.

* * * * *